United States Patent [19]

Marletta

[11] 4,339,126

[45] Jul. 13, 1982

[54] ROLLABLE DEVICE FOR RECEIVING A USER'S LIMBS DURING EXERCISE

[76] Inventor: Gianfranco Marletta, Via Calamandrei 1, Cinisello Balsamo (Milan), Italy

[21] Appl. No.: 186,020

[22] Filed: Sep. 10, 1980

[30] Foreign Application Priority Data

Oct. 4, 1979 [IT] Italy ..... 26265 A/79

[51] Int. Cl.[3] ..... A63B 21/00

[52] U.S. Cl. ..... 272/127

[58] Field of Search ..... 272/109, 93, 132, 144, 272/71, 116, 128, 127, 64, 114, 115; 280/206, 207; 63/31

[56] References Cited

U.S. PATENT DOCUMENTS 1,256,734 2/1918 Rumke ..... 272/109

2,697,478 12/1954 McKinney ..... 272/144 X 3,006,645 10/1961 Frazier ..... 272/109

3,767,191 10/1973 Riley ..... 272/127 X

*Primary Examiner*—Richard C. Pinkham

*Assistant Examiner*—William R. Browne

*Attorney, Agent, or Firm*—Diller, Ramik & Wight

[57] ABSTRACT

An apparatus for use in the performance of gymnastic movements and includes an inner tubular support for receiving and supporting the lower limbs of a gymnast, an outer annular casing housing the tubular support, the tubular support and the annular casing being rotatable relative to each other, and the outer annular casing including a peripheral exterior surface of a generally outwardly convexly curved configuration for continuously and uninterruptedly contacting the ground upon motion being imparted to the apparatus by the lower limbs of the gymnast.

11 Claims, 3 Drawing Figures

ROLLABLE DEVICE FOR RECEIVING A USER'S LIMBS DURING EXERCISE

The present invention relates to an advantageous apparatus adapted in particular to aid the gymnast in the execution of given gymnastic movements.

Display gymnastics, callisthenics, etc., call for exercises in which the body must perform somewhat tiring movements which require training and practice. In this field, one technical problem that an equipment designer may be called upon to solve is to embody an apparatus such as relieves the gymnast of muscular fatigue but at the same time enables him to execute correctly whatever movement is involved. The more complex the movement of the gymnast, the more intricate is the problem of the designer.

There is in particular one known exercise in which the gymnast has to move his lower limbs on a horizontal plane, supporting himself with both hands, or with one or the other hand, on a fixed support surface, maintaining his trunk, clearly, in a substantially vertical position. From this it follows that as well as performing a rotation on the horizontal plane, the lower limbs also perform a combined rotation about themselves. Some practical expedients have been proposed for supporting the lower limbs during this exercise, which is clearly difficult for beginners, but without satisfactory results. For example, the lower limbs can be placed into a ring supported by a long rope secured to the ceiling in an approximately vertical position above the body of the gymnast. An expedient of this kind obviously cannot be used by persons wishing to practice in their own homes or in places without an attachment point for the rope; but, above all, this type of constraint of the legs makes it impossible to execute the exercise correctly. It has now been found that an apparatus with special kinematic characteristics provides the gymnast executing the aforesaid exercise with a correct support for his lower limbs; furthermore, the solution in question is technologically not difficult to embody and so the user can have at his disposal an apparatus which is at the same time efficient and not over-costly.

This and other purposes to be made clearer hereinafter have been achieved by embodying an apparatus for the execution of gymnastic movements, characterized by the fact that it consists of a support for the lower limbs of the gymnast, around which support a roller casing is constrained in rotatable manner.

The following description of an exemplifying embodiment of the present invention provides a detailed analysis of the characteristics of the invention, with reference to the attached drawings in which.

Figure 1:
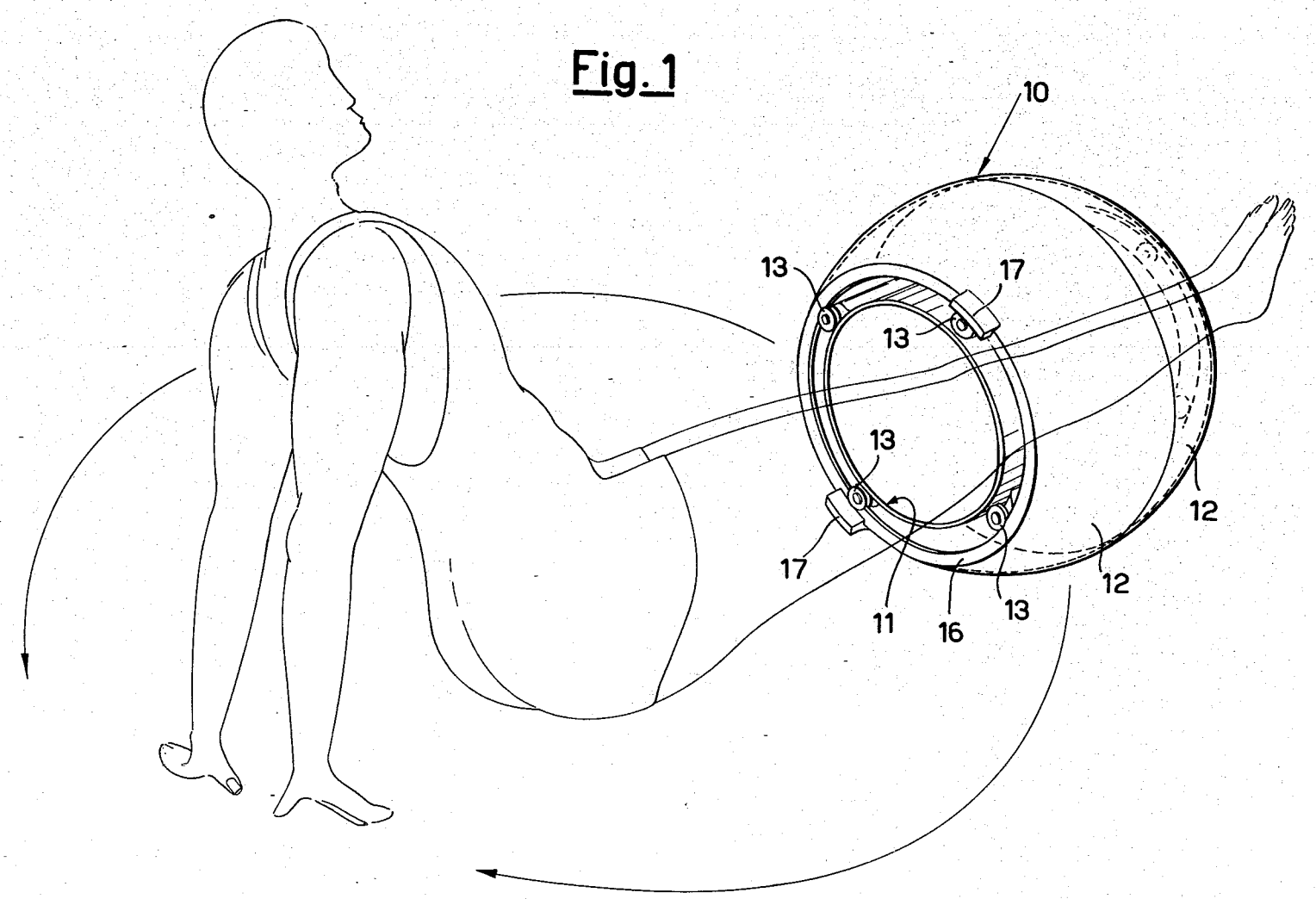
FIG. 1 is a schematic perspective view of an apparatus according to the invention during use.
Figure 3:
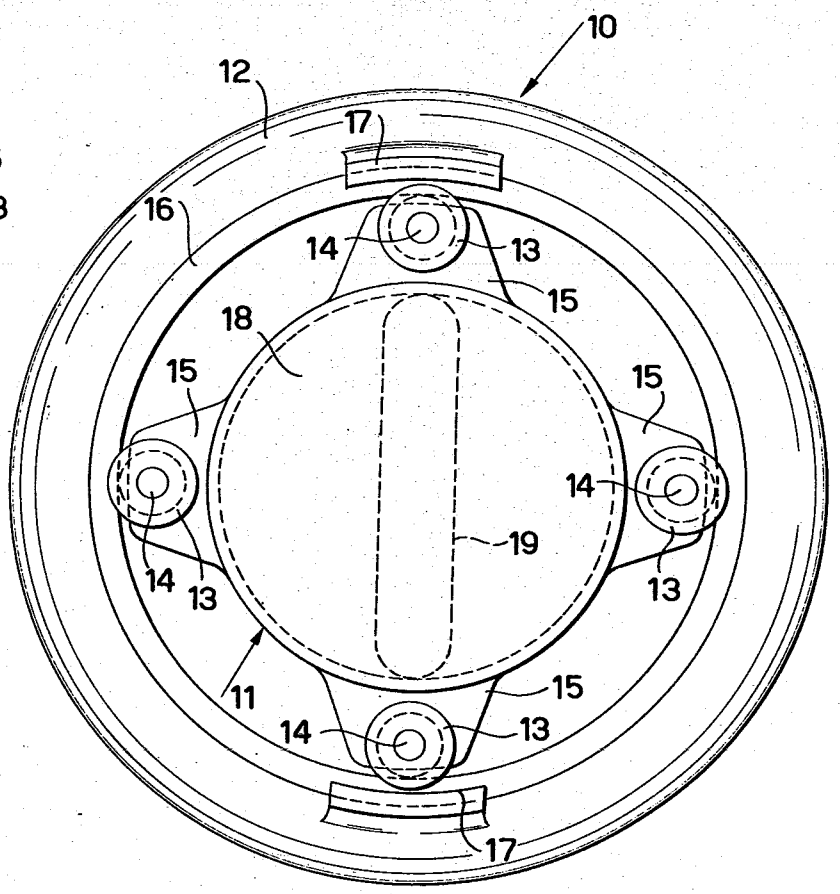
FIG. 3 is a front view of the apparatus of FIG. 2.
Figure 2:
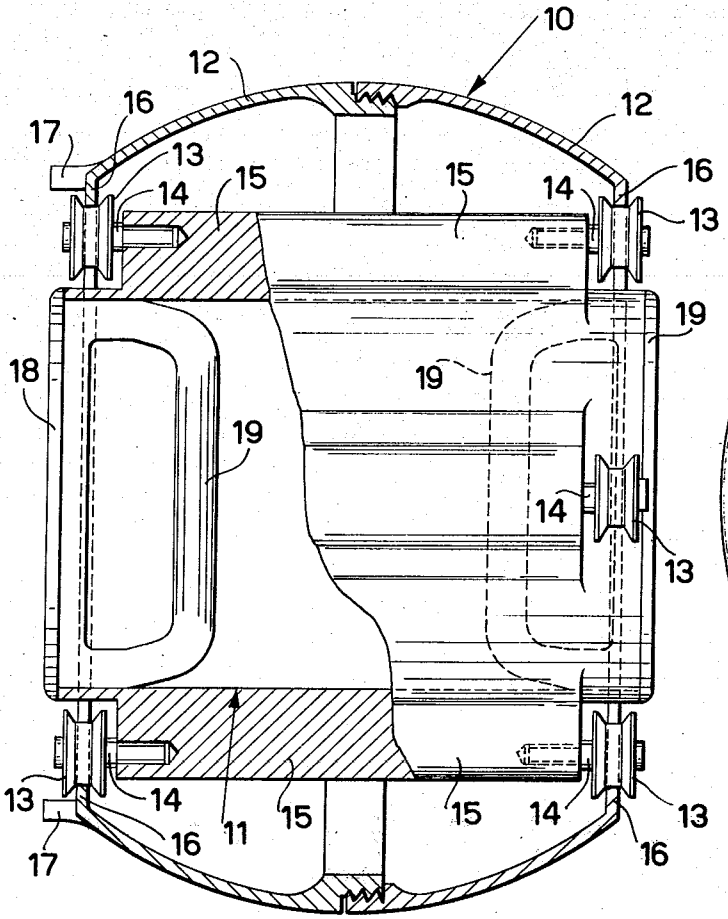
FIG. 2 is a partially sectional lateral view of the apparatus of FIG. 1.

As illustrated in the drawings, an apparatus for use in the execution of gymnastic movements generally indicated by 10 consists essentially of a hollow cylinder 11, open at both ends, into which the gymnast can place his lower limbs and about which a roller casing 12 is constrained in a rotatable manner. The casing 12 and the cylinder 11 are interconnected so as to allow rotation by means of wheels 13 each idly rotatable about a shaft 14 mounted in reinforcement projections 15 distributed around the cylinder. The wheels roll on their grooves on the rim 16 of the casing and slide thereon in this manner, thus forming a coupling arrangement which is conceptually like that of rolling bearings. The casing illustrated has a bulbous shape, in particular like that of a spherical segment with two bases, so as to allow the apparatus to oscillate and thus adapt to the different angular positions of the legs of the gymnast.

In use, the gymnast places his legs inside the apparatus which is rested on the ground; he is then able to move his legs, for example performing the gymnastic movement described at the outset, as shown in FIG. 1. In this way the casing rotates by rolling on the ground, while the cylinder in its turn rotates with the lower limbs, which clearly rotate about themselves while they rotate on the horizontal plane. The legs of the gymnast are provided with an effective support and the effort required to keep the legs in the raised position is thus obviated.

One particular configuration of the apparatus can provide for its use also as a revolving chair, with feet 17 and with closure 18 adapted to the openings of the cylinder 11. The closures, moreover, can be fitted with grips 19, useful for the gymnast who performs the exercise of FIG. 1 and who grips them while resting on the ground.

The execution that has been described has the sole purpose of making known the functional principles of the invention, in that there are an infinite number of variants that can be applied to it without however falling outside the scope of the functionality thereof.

The rotating coupling between casing and cylinder can be either, as shown, of the roller type employing balls, rollers or other means, or in the form of a plain bearing, provided that materials are used which ensure a sufficiently low degree of friction such as will not impede the performance of the exercise, i.e. the reciprocal rotation of internal body and casing. It is not essential for the inner part to be cylindrical, since externally it is sufficient for it to have a rolling coupling with the casing and thus internally the apparatus can have any form that is capable of receiving the legs of the gymnast.

The form of the outer casing can be equally varied; it can be of spherical or comparable type, for example a segment of an ellipsoid, and can also be of extremely small width as compared to the outer casing, so as to form a kind of wheel.

Thus the details of construction and the configuration of the component parts may vary, as also the materials used, in relation to the professional or amateur use for which the apparatus is intended and also in relation to whether such use is for adults or children.

I claim:

1. An apparatus for use in the performance of gymnastic movements comprising an elongated tubular support means for receiving and supporting the lower limbs of a gymnast, an outer generally barrel shaped casing housng said supporting means, means for rotatably journalling said generally casing relative to said support means, said support means further comprising substantially spaced apart rotatable journaling means positioned substantially at the ends of the tubular support means, and said generally casing including peripheral exterior surface means for continuously and uninterruptedly contacting the ground upon motion being imparted to said apparatus by the lower limbs of a gymnast.

2. The apparatus as defined in claim 1 wherein said casing is a surface rolling segment, an ellipsoid.

3. The apparatus as defined in claim 1 wherein said generally barrel shaped casing carries a plurality of feet for adapting said apparatus for use as a chair.

4. The apparatus as defined in claim 1 wherein said generally barrel shaped casing carries a plurality of feet for adapting said apparatus for use as a chair, and said support means being a generally open ended tube.

5. The apparatus as defined in claim 1 wherein said generally barrel shaped casing carries a plurality of feet for adapting said apparatus for use as a chair, said support means being a generally open ended tube, and a removable closure closing at least one end of said tube.

6. The apparatus as defined in claim 1 where said generally barrel shaped casing carries a plurality of feet for adapting said apparatus for use as a chair, said support means being a generally open ended tube, a removable closure closing at least one end of said tube, and said closure carries a hand grip.

7. The apparatus as defined in claim 1 wherein said support means is a generally open ended tube, and a removable closure closing at at least one end of said tube.

8. The apparatus as defined in claim 1 wherein said support means is a generally open ended tube, a removable closure closing at at least one end of said tube, and said closure carries a hand grip.

9. The apparatus as defined in claim 1 wherein said generally barrel shaped casing is defined by two annular halves.

10. The apparatus as defined in claim 1 wherein said generally barrel shaped casing is defined by two annular halves, and means removably coupling said annular halves to each other.

11. The apparatus as defined in claim 1 wherein said support means is substantially tubular, said casing is a relatively broad generally outwardly convexly curved surface, and said apparatus is utilized with the axis of said tubular support means disposed generally horizontally with said surface when in ground engagement.

* * * * *